US011555314B1

(12) United States Patent
Adams

(10) Patent No.: US 11,555,314 B1
(45) Date of Patent: Jan. 17, 2023

(54) SIDING HANGING GAUGE

(71) Applicant: Lone Hanger, LLC, Merritt Island, FL (US)

(72) Inventor: Robert C. Adams, Merritt Island, FL (US)

(73) Assignee: Lone Hanger, LLC, Merritt Island, FL (US)

( * ) Notice: Subject to any disclaimer, the term of this patent is extended or adjusted under 35 U.S.C. 154(b) by 0 days.

(21) Appl. No.: 17/897,850

(22) Filed: Aug. 29, 2022

(51) Int. Cl.
*E04F 21/18* (2006.01)
*E04F 13/08* (2006.01)

(52) U.S. Cl.
CPC ..... *E04F 21/1855* (2013.01); *E04F 13/0864* (2013.01)

(58) Field of Classification Search
CPC ..... E04F 21/1855; E04F 13/0864
See application file for complete search history.

(56) References Cited

U.S. PATENT DOCUMENTS 182,187 A * 9/1876 Green ..... E04F 21/1855 33/646
331,519 A * 12/1885 McDonald ..... E04F 21/1855 33/647
351,722 A * 10/1886 Trueblood ..... E04F 21/1855 33/647
565,299 A * 8/1896 Ratcliff ..... E04F 21/1855 33/646
3,463,480 A * 8/1969 Edstrom ..... E04F 21/1855 33/646
3,792,852 A 2/1974 Reniker
3,977,145 A * 8/1976 Dobby ..... E04F 13/0864 52/553
4,155,175 A 5/1979 Stiles
4,314,429 A 2/1982 Casteel et al.
4,435,933 A 3/1984 Krowl
4,509,291 A 4/1985 Geisthardt
4,654,975 A 4/1987 Lopez
(Continued)

FOREIGN PATENT DOCUMENTS

WO WO-2016064033 A1 * 4/2016 ..... E04F 21/18

*Primary Examiner* — Rodney Mintz
(74) *Attorney, Agent, or Firm* — Brian S. Steinberger; Hilary F. Steinberger; Law Offices of Brian S. Steinberger, P.A.

(57) ABSTRACT

Devices, tools apparatus, kits, systems and methods for providing a gauge and tool for allowing a single installer to install siding boards, such as cedar and pine lap siding and Cementous boards on exterior walls. An installer can use two gauges to and install exterior wall siding on all sides of a building without a second installer. Each gauge can be cut from sheets of metal, such as aluminum having a thickness of approximately 0.09 inches. Each gauge can have a front generally rectangular panel with a left bent side with an upper left ledge and a lower left step, and a right bent side with an upper right ledge, and a lower right step, a first top middle panel extending upward from the rectangular panel between the left bent side and the right bent side, and a first mounting hole through the front generally rectangular panel. An installer can initially mount a bottom first siding panel on a wall. The gauges can allow siding such as 7.25" height siding to have a 6" reveal when the lap siding is constructed on a wall.

18 Claims, 9 Drawing Sheets

(56) References Cited

U.S. PATENT DOCUMENTS 4,879,818 A * 11/1989 Beaulieu ..... G01B 3/30 33/646
4,899,459 A 2/1990 Taggart
4,972,647 A * 11/1990 Meldrum ..... E04F 13/0864 52/52
5,195,412 A 3/1993 Flemming et al.
D334,892 S 4/1993 Jenkins
D338,814 S 8/1993 Wright, Jr. et al.
5,290,019 A 3/1994 Beyers
5,305,532 A * 4/1994 Johnson ..... G01B 3/30 33/666
5,319,909 A * 6/1994 Singleterry ..... E04F 21/1855 52/DIG. 1
5,370,377 A * 12/1994 Van Der Meer .... E04F 21/1855 33/647
5,465,499 A 11/1995 LaPlante
5,692,311 A * 12/1997 Paquin ..... E04F 21/1855 33/647
6,112,481 A 9/2000 Schiedegger et al.
6,296,133 B1 10/2001 Cobane
6,385,927 B2 5/2002 Schiedegger et al.
6,484,411 B1 * 11/2002 Nixon ..... E04F 21/1855 33/411
6,494,016 B1 12/2002 Bankson
6,554,254 B2 4/2003 Vetesnik
6,640,512 B1 11/2003 Kinnaman et al.
6,705,021 B2 * 3/2004 Nadal ..... E04F 21/1855 33/647
6,886,268 B1 5/2005 Morse
6,904,729 B1 6/2005 Shroyer
7,020,976 B2 * 4/2006 Just ..... E04F 21/1855 33/647
7,134,253 B2 * 11/2006 Edwards ..... E04F 21/1855 52/749.11
7,185,443 B2 3/2007 Penhale
7,434,329 B2 10/2008 Walda
7,441,382 B2 10/2008 Beck et al.
7,490,447 B2 2/2009 Ouellette et al.
7,823,853 B2 11/2010 Larson et al.
9,951,534 B2 * 4/2018 Menges ..... E04F 21/1855
10,221,575 B2 3/2019 Steffes et al.
10,487,515 B2 11/2019 Steffes et al.
10,544,593 B2 1/2020 Schultz et al.
10,683,670 B1 6/2020 Rush
2001/0030268 A1 10/2001 Larson
2001/0032423 A1 10/2001 Schiedegger et al.
2002/0023366 A1 * 2/2002 Bueno ..... E04D 1/34 33/647
2003/0006403 A1 1/2003 Vetesnik
2003/0014877 A1 * 1/2003 Nadal ..... E04F 21/1855 33/647
2004/0020066 A1 2/2004 Morey
2004/0074188 A1 4/2004 Beck et al.
2004/0237461 A1 * 12/2004 Edwards ..... E04F 21/1855 52/749.1
2004/0244214 A1 * 12/2004 Just ..... E04F 21/1855 33/649
2005/0188646 A1 9/2005 Penhale
2005/0262792 A1 12/2005 Walda
2006/0053736 A1 * 3/2006 Patton ..... E04F 21/1855 52/846
2006/0102577 A1 5/2006 Vestenik
2007/0068115 A1 3/2007 Ouellette et al.
2007/0245681 A1 * 10/2007 Patton ..... E04F 21/1855 52/846
2008/0053025 A1 3/2008 Howe et al.
2009/0019787 A1 1/2009 Larson et al.
2013/0205712 A1 * 8/2013 Butler ..... E04F 21/1855 52/749.1
2016/0289981 A1 * 10/2016 Menges ..... E04F 21/1855
2018/0112416 A1 4/2018 Steffes et al.
2018/0187421 A1 7/2018 Schultz et al.
2019/0169857 A1 6/2019 Steffes et al.
2019/0309898 A1 10/2019 Krake et al.
2020/0131781 A1 4/2020 Schultz et al.
2021/0230878 A1 7/2021 Pina et al.

* cited by examiner

FIG. 3B
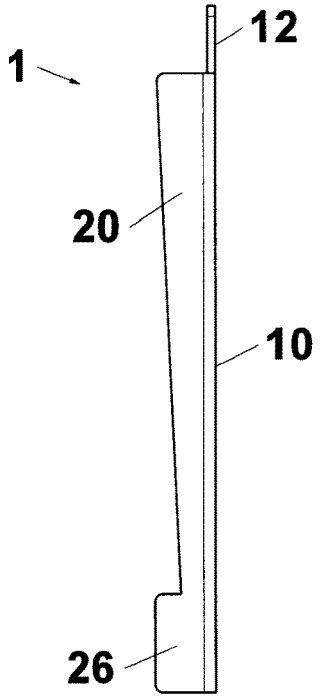
FIG. 3A
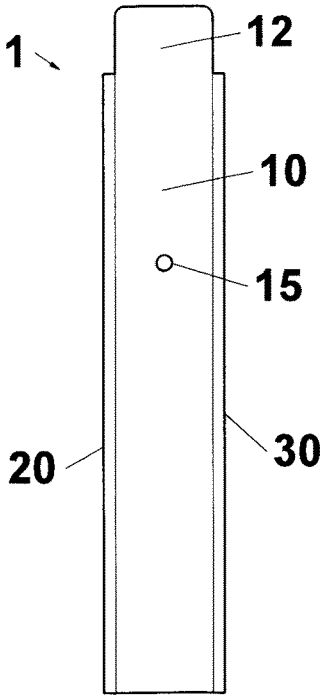
FIG. 3C
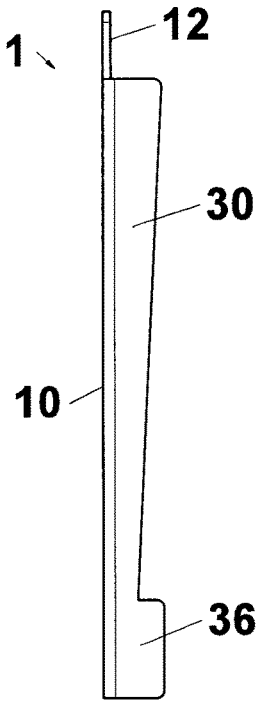
FIG. 3E
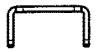
FIG. 3D
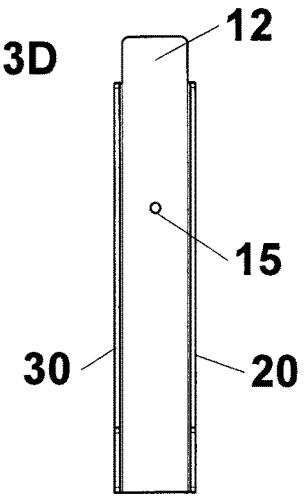
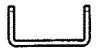
FIG. 3F FIG. 4C
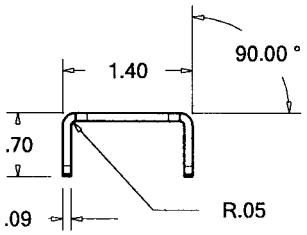
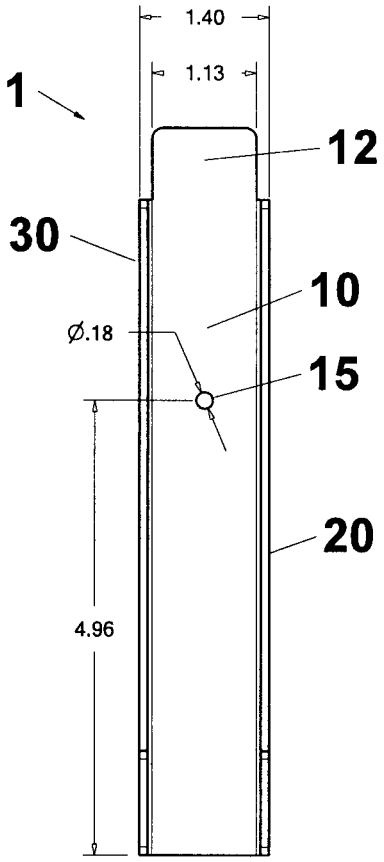
FIG. 4A
FIG. 4B
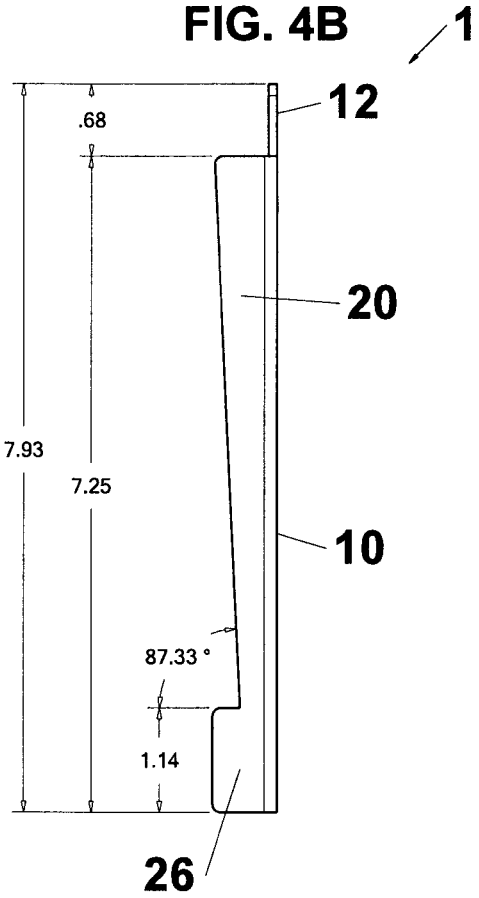

FIG. 8B
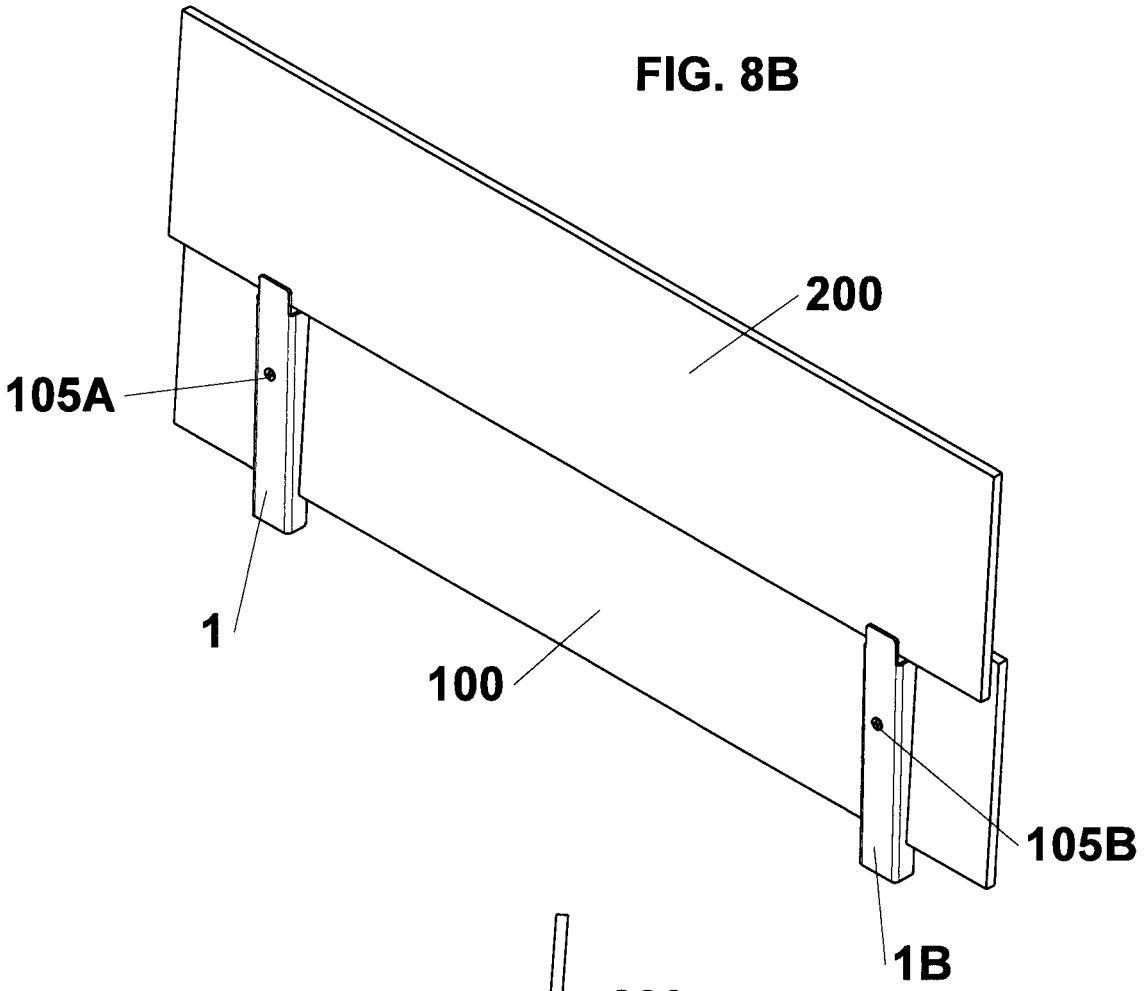
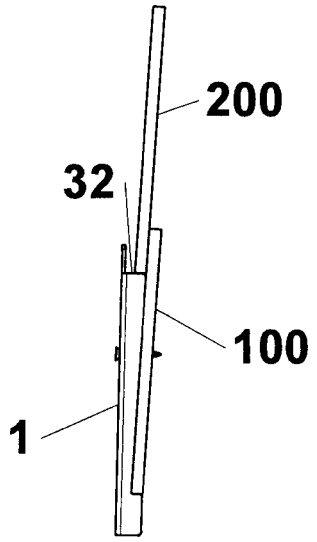
FIG. 8C

FIG. 8E
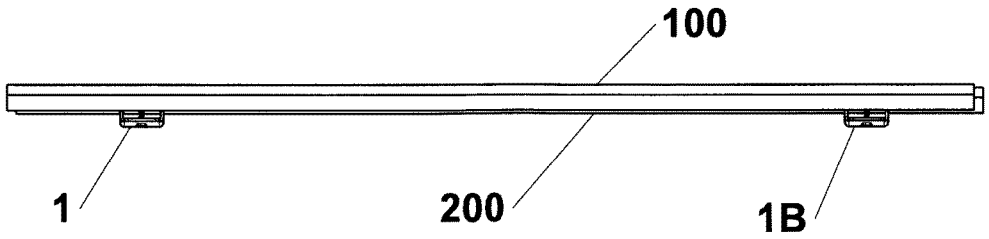
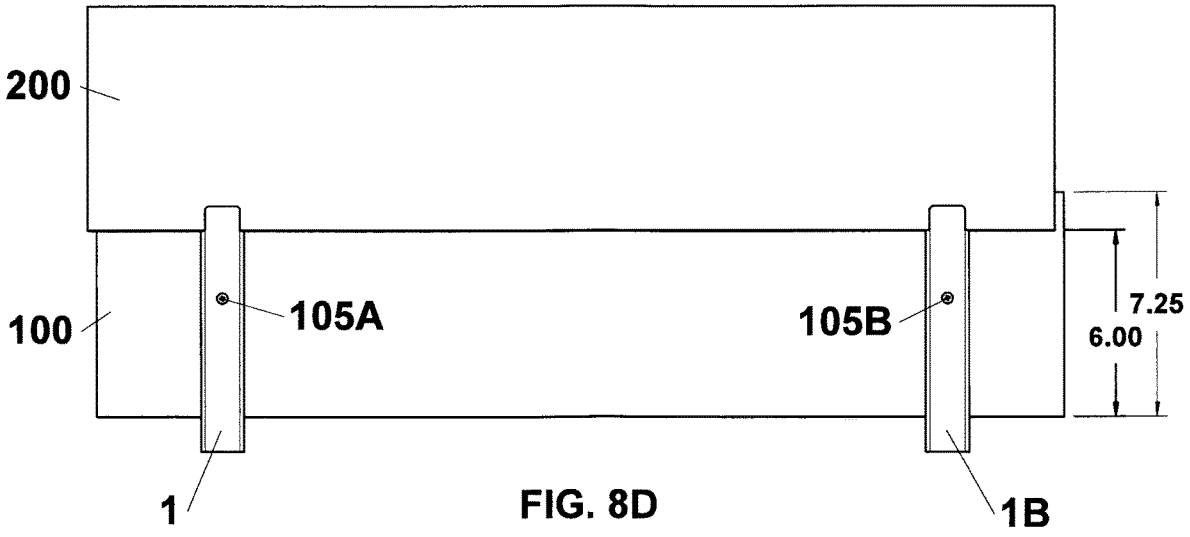
FIG. 8D

SIDING HANGING GAUGE

FIELD OF INVENTION

This invention relates to siding tools, and in particular to devices, tools apparatus, systems and methods for providing a gauge and tool for allowing a single installer to install siding boards, such as cedar and pine lap siding and Cementous boards on exterior walls.

BACKGROUND AND PRIOR ART

Lap siding is well known to be used for exteriors on residential buildings, apartment buildings and commercial buildings. Siding has included wood boards, such as cedar and pine. Popular siding material further includes fiber cement siding, such as HardiePlank® and HARDIE® board plank lap siding by James Hardie Technology LTD Corp of Ireland. Siding lap boards come different lengths including 8', 12' and 16' and smaller cut sizes. The height of the lap boards has generally included 5¼", 7¼", and 8½". The lap boards are generally long and heavy to carry, and can have weights up to approximately 12 pounds per square foot Because of their size and weight, it is very cumbersome to maneuver the siding lap board panels into place to a desired overlap position when constructing a lap siding wall.

A common installation requires a crew of 2 or more workers to hang the boards, and position each next overhanging board. Each additional installer adds additional labor and time costs on a construction job, which can add thousands of dollars and more to each installation. In addition to the labor costs, extra costs, such as workman's compensation for insurance must also be added to the cost and passed down to the property owner.

As such, there is a need to reduce the construction costs for installing lap siding boards.

SUMMARY OF THE INVENTION

A primary objective of the present invention is to provide devices, tools apparatus, systems and methods for providing a gauge and tool for allowing a single installer to install siding boards, such as cedar and pine lap siding and Cementous boards on exterior walls.

A secondary objective of the present invention is to provide, devices, tools apparatus, systems and methods for installing siding boards that is inexpensive to manufacture, and is reusable.

A tool gauge kit for installing lap siding on a wall, can include

- a first gauge having front generally rectangular panel with a left bent side with an upper left ledge and a lower left step, and a right bent side with an upper right ledge, and a lower right step,
- a first top middle panel extending upward from the rectangular panel between the left bent side and the right bent side, and a first mounting hole through the front generally rectangular panel; and
- a second gauge having front generally rectangular panel with a left bent side with an upper left ledge and a lower left step, and a right bent side with an upper right ledge, and a lower right step,
- a second top middle panel extending upward from the rectangular panel between the left bent side and the right bent side, and a second mounting hole through the second gauge front generally rectangular panel,

- wherein the first gauge and the second gauge are parallel and spaced apart to be attached to an installed first siding panel on a vertical wall with a first screw and a second screw attached through the first mounting hole and the second mounting hole, and the lower left step and the lower right step of both the first gauge and the second gauge are positioned under a lower edge of the installed first siding panel, and a second siding panel is positioned on both the upper left ledge and the upper right ledge of the first gauge and on both the upper left ledge and the upper right ledge of the second gauge, followed by attaching the second siding panel to the vertical wall.

The first gauge and the second gauge can be formed from an aluminum plate and include a thickness of approximately 0.09".

The first gauge and the second gauge can be formed from a metal.

The first gauge and second gauge can be formed from molded plastic.

The first gauge and the second gauge can have a height of approximately 7.25" from a bottom to each of the upper left ledge and the upper right ledge to allow a reveal of the second siding panel to be approximately 6".

Each of the first gauge and the second gauge can have a height of approximately 8.5" from a bottom to each of the upper left ledge and the upper right ledge to allow a reveal of the second siding panel to be approximately 7".

The first gauge and the second gauge can have a height of approximately 5.25" from a bottom to each of the upper left ledge and the upper right ledge to allow a reveal of the second siding panel to be approximately 4".

A system for installing lap siding on a wall, can include:

- a first gauge having front generally rectangular panel with a left bent side with an upper left ledge and a lower left step, and a right bent side with an upper right ledge, and a lower right step,
- a first top middle panel extending upward from the rectangular panel between the left bent side and the right bent side, and a first mounting hole through the front generally rectangular panel; and
- a second gauge having front generally rectangular panel with a left bent side with an upper left ledge and a lower left step, and a right bent side with an upper right ledge, and a lower right step,
- a second top middle panel extending upward from the rectangular panel between the left bent side and the right bent side, and a second mounting hole through the second gauge front generally rectangular panel,
- wherein the first gauge and the second gauge are positioned to be parallel and spaced apart to be attached to an installed first siding panel on a vertical wall with a first screw and a second screw attached through the first mounting hole and the second mounting hole, and the lower left step and the lower right step of both the first gauge and the second gauge are positioned under a lower edge of the installed first siding panel, and a second siding panel is positioned on both the upper left ledge and the upper right ledge of the first gauge and on both the upper left ledge and the upper right ledge of the second gauge, followed by attaching the second siding panel to the vertical wall.

A tool gauge for hanging siding panels, can include: a front generally rectangular panel with a left bent side with an upper left ledge and a lower left step, and a right bent side with an upper right ledge, and a lower right step, a top middle panel extending upward from the rectangular panel between the left bent side and the right bent side, and a first mounting hole through the front generally rectangular panel; wherein the gauge is attached to an installed first siding panel on a vertical wall with a fastener attached through the mounting hole, and the lower left step and the lower right step is positioned under a lower edge of the installed first siding panel, followed by positioning a second siding panel on both the upper left ledge and the upper right ledge of the gauge, and attaching the second siding panel to the vertical wall.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

FIG. 3A is a front view of the gauge of FIG. 1A.

FIG. 3B is a left side view of the gauge of FIG. 1A.

FIG. 3C is a right side view of the gauge of FIG. 1A.

FIG. 3D is a rear side view of the gauge of FIG. 1A.

FIG. 3E is a top view of the gauge of FIG. 1A.

FIG. 3F is a bottom view of the gauge of FIG. 1A.

FIG. 4A is another front view of the gauge of FIG. 3A with dimensions.

FIG. 4B is another right side view of the gauge of FIG. 3B with dimensions.

FIG. 4C is another top view of the gauge of FIG. 3E with dimensions.

FIG. 8B is an enlarged view of the first and second siding panel shown in FIG. 8A.

FIG. 8C is a right side view of FIG. 8B.

FIG. 8D is another view of FIG. 8C with panel and reveal dimensions.

FIG. 8E is a top view of FIG. 8D.

DESCRIPTION OF THE PREFERRED EMBODIMENTS

Figure 1A:
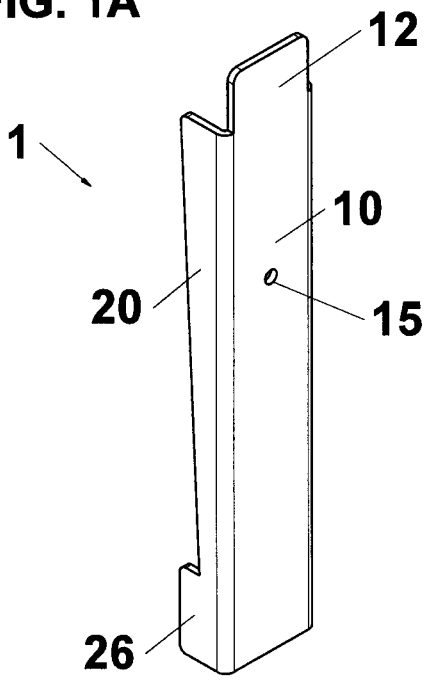
FIG. 1A is an upper front left perspective view of the siding installation gauge.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown.

This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1 gauge/tool
1B second gauge/tool
10 front face
12 top rectangular section
15 mount hole
20 left side section
22 left flat top ledge
24 left angled side edge
25 step to left foot
26 left foot
30 right side section
32 right flat top ledge
34 right angled side edge
35 step to right foot
36 right foot

Figure 1B:
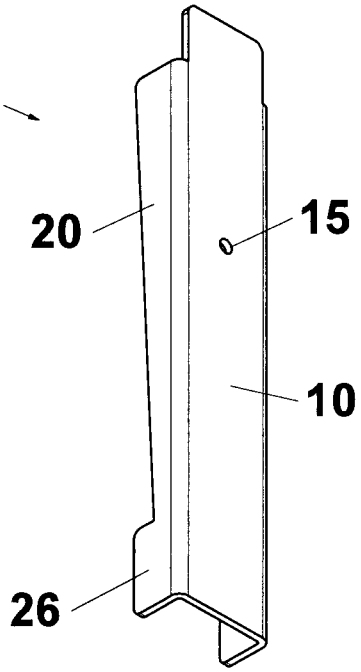
FIG. 1B is a lower front perspective view of the gauge of FIG. 1A.

40 flat bottom
90 vertical wall
100 first siding panel
105A first screw
105B second screw
115 panel screws
200 second siding panel
A. first assembly step
B. second assembly step
C. third assembly step
D fourth assembly step FIG. 1A is an upper front left perspective view of the siding installation gauge 1. FIG. 1B is a lower front perspective view of the gauge 1 of FIG. 1A.

Figure 1C:
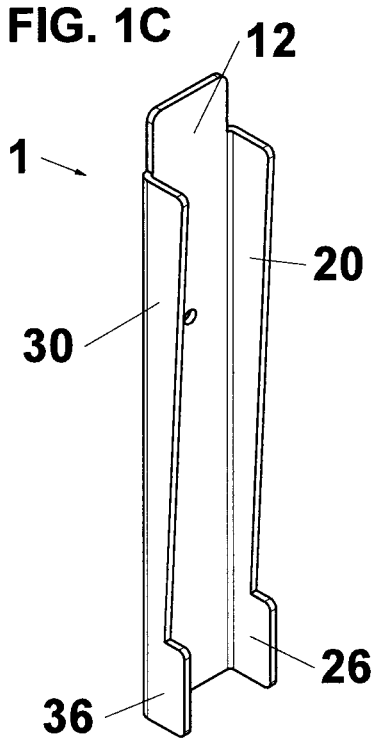
FIG. 1C is an upper rear left perspective view of the gauge of FIG. 1A.

FIG. 1C is an upper rear left perspective view of the gauge 1 of FIG. 1A.

Figure 1D:
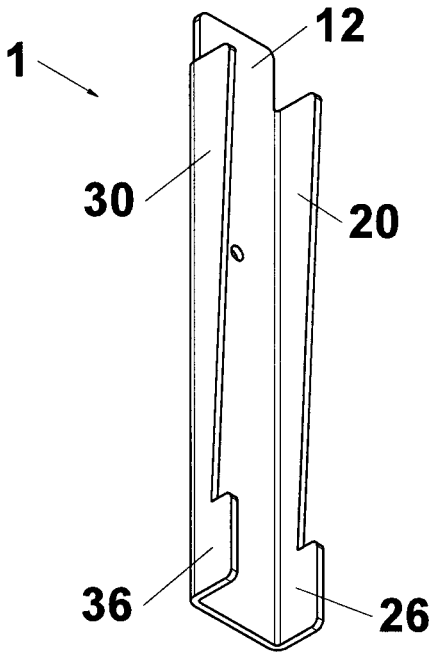
FIG. 1D is a lower rear left perspective view of the gauge of FIG. 1A.

FIG. 1D is a lower rear left perspective view of the gauge 1 of FIG. 1A.

Figure 2A:
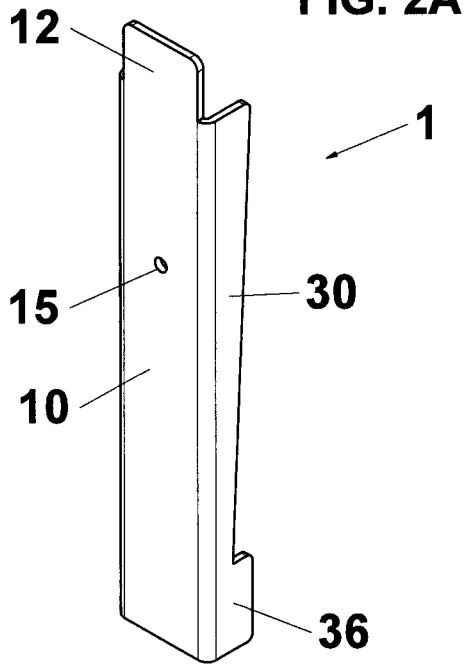
FIG. 2A is an upper front right perspective view of the gauge of FIG. 1A.

FIG. 2A is an upper front right perspective view of the gauge 1 of FIG. 1A.

Figure 2B:
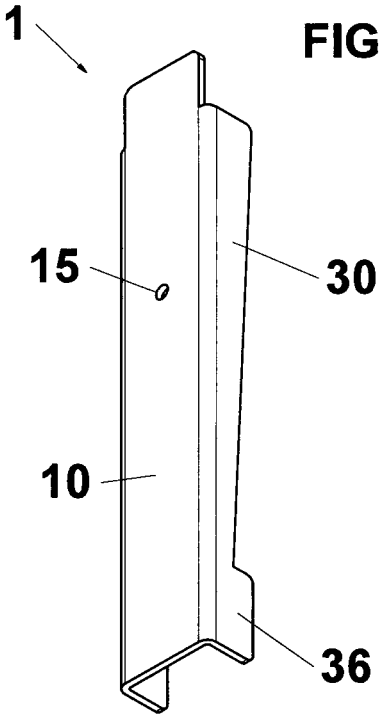
FIG. 2B is a lower front right perspective view of the gauge of FIG. 1A.

FIG. 2B is a lower front right perspective view of the gauge 1 of FIG. 1A.

Figure 2C:
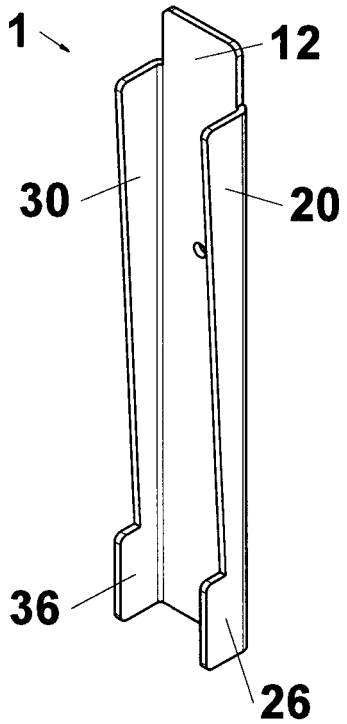
FIG. 2C is an upper rear right perspective view of the gauge of FIG. 1A.

FIG. 2C is an upper rear right perspective view of the gauge 1 of FIG. 1A.

Figure 2D:
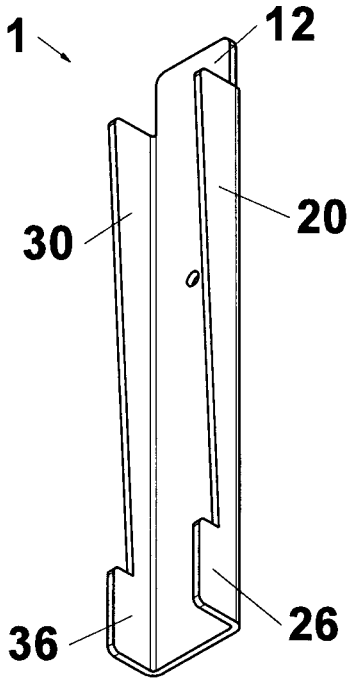
FIG. 2D is a lower rear right perspective view of the gauge of FIG. 1A.

FIG. 2D is a lower rear right perspective view of the gauge of FIG. 1A.

FIG. 3A is a front view of the gauge 1 of FIG. 1A.

FIG. 3B is a left side view of the gauge 1 of FIG. 1A.

FIG. 3C is a right side view of the gauge 1 of FIG. 1A.

FIG. 3D is a rear side view of the gauge 1 of FIG. 1A.

FIG. 3E is a top view of the gauge 1 of FIG. 1A.

FIG. 3F is a bottom view of the gauge 1 of FIG. 1A.

FIG. 4A is another front view of the gauge 1 of FIG. 3A with dimensions.

FIG. 4B is another right side view of the gauge of FIG. 3B with dimensions.

FIG. 4C is another top view of the gauge 1 of FIG. 3E with dimensions.

Figure 5:
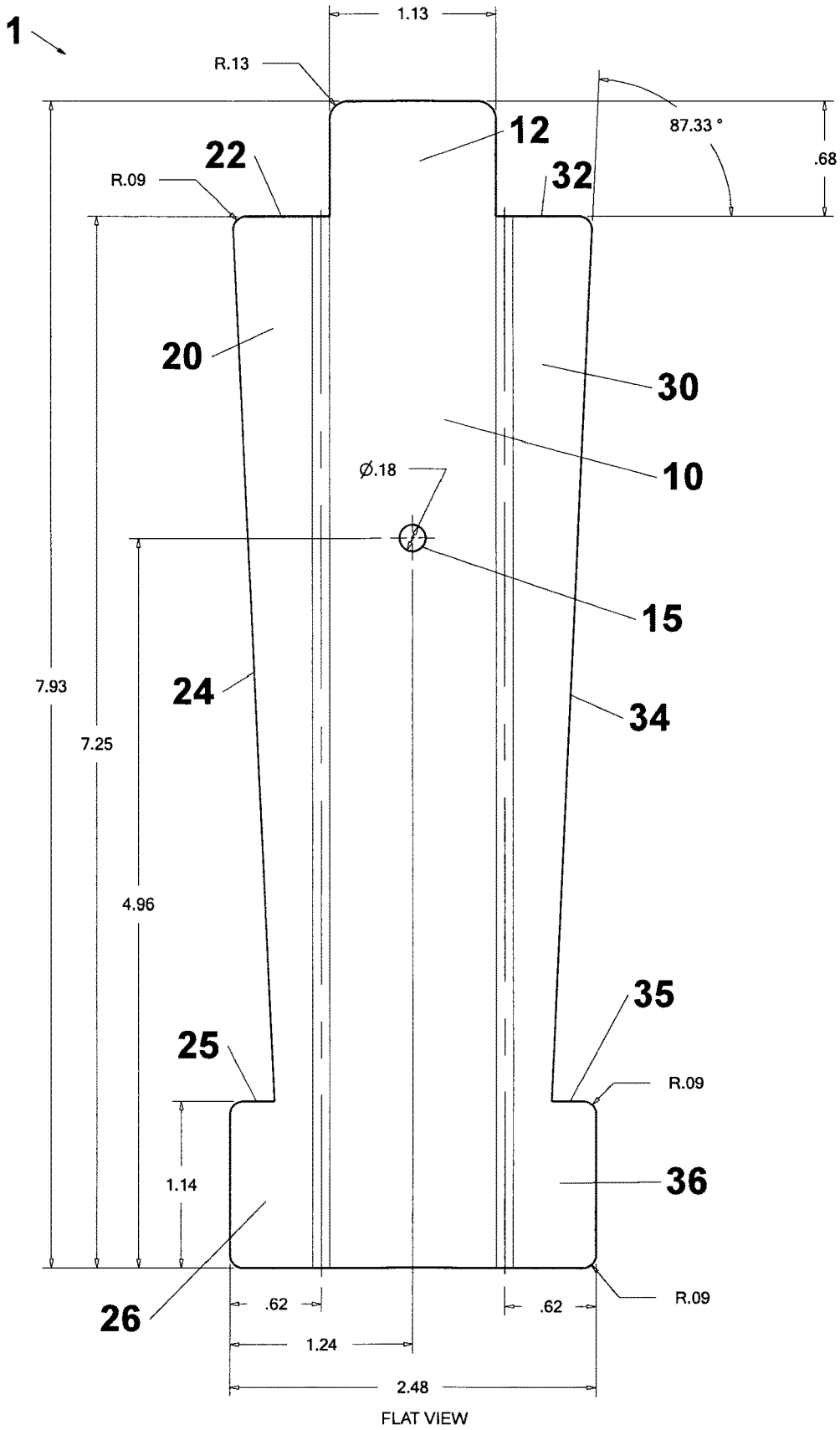
FIG. 5 is a rear flat view of the gauge of FIG. 1A.

FIG. 5 is a rear flat view of the gauge 1 of FIG. 1A with dimensions.

Referring to FIGS. 1A-5, the gauge 1 can be originally formed from aluminum having a thickness of approximately 0.90", and cut to a flat shape shown in FIG. 5.

Referring to FIGS. 1A-5, the left side section 10 can be bent to be approximately perpendicular to the front face 10, with a left flat top 22, left angled side edge 24 which angles inwardly approximately 87.33 degree to a left foot 26.

The right side section 20 can be bent to be approximately perpendicular to the front face 10, with a right flat top 32, right angled side edge 34 which angles inwardly approximately 87.33 degrees to a right foot 36.

The top of the gauge 1 can have a rectangular section 12 extending upward midway between the top of the left side section 20 and the right side section 30.

The bottom of the gauge 1 can have a flat bottom 40.

Referring to FIGS. 4A-5, the gauge 1 can have a mounting hole 15 approximately 4.96" above the flat bottom 40, and approximately 1.24" from the outer side edge of foot 26 and foot 36.

The gauge 1 can have a height of approximately 7.93" between the flat bottom 40 and top rectangular section 12. The top rectangular section 12 can have a width of approximately 1.13" and a height of approximately 0.68"

The left side section 20 can have a height of approximately 7.25" between the bottom 40 and left flat top 22. The left foot 26 can have a height of approximately 1.14".

The right side section 30 can having a height of approximately 7.25" between the bottom 40 and right flat top 32. The right foot 36 can have a height of approximately 1.14".

The gauge tool 1 can be made from aluminum sheets, that are cut, into the shape shown in FIG. 5 and have the left side section 20 and right side section 30 bent into the approximately perpendicular positions shown in FIGS. 1A-4C.

Figure 6:
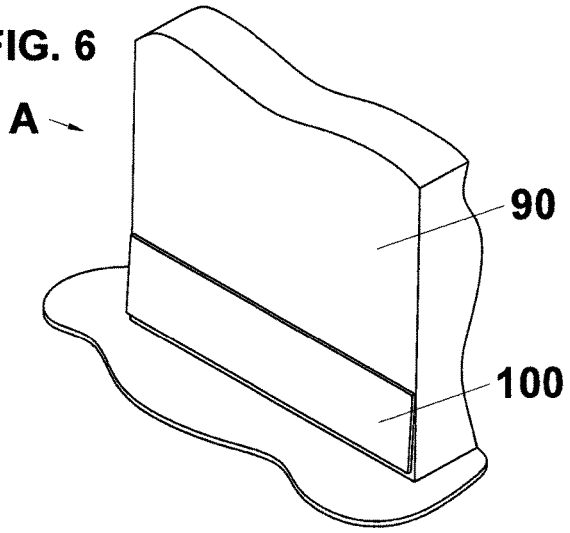
FIG. 6 is a perspective view of a first step of a first lap siding panel mounted to a vertical wall.

FIGS. 6A-9B show the assembly steps of using the novel gauges 1 for constructing lap siding on a vertical wall. In the assembly steps, a popular siding board panel having a height of approximately 7.25 inches is shown, such as but not limited to cedar and pine lap siding and Cementous boards FIG. 6 is a perspective view of a first step of a first lap siding panel 100 mounted to a vertical wall 90. The installer will initially mount a first lap siding panel 100 on a wall 9 such as the bottom of the wall to start the construction project. The installer can use traditional fasteners, such as but not limited to screws, nails and the like, to mount the first lap siding panel 100 on the wall 90.

Figure 7:
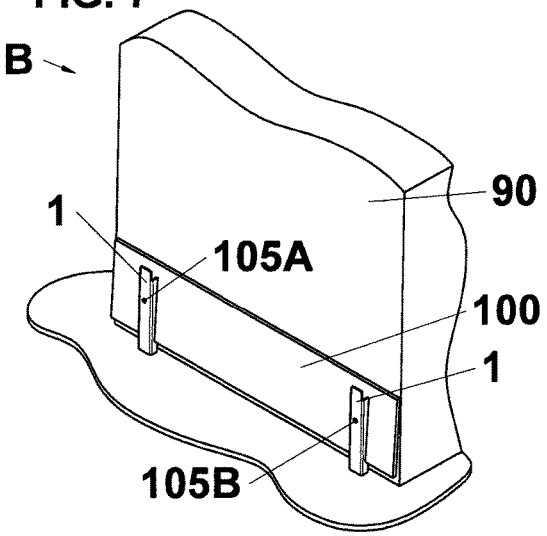
FIG. 7 is a perspective view of a second step of two gauges attached to the first mounted siding panel shown in FIG. 6.

FIG. 7 is a perspective view of a second step of positioning and attaching two gauges 1 to the first mounted siding panel shown 100 in FIG. 6.

Referring to FIGS. 1A-5 and 7, a first gauge 1 and a second gauge 1B are initially positioned to be parallel and spaced apart to be attached to an installed first siding panel 100 on a vertical wall 90 with a first screw 105A and a second screw 105B attached through each mounting hole 15. And the lower left step 25 and the lower right step 35 of both the first gauge 1 and the second gauge 1B are positioned under a lower edge of the installed first siding panel 100.

Figure 8A:
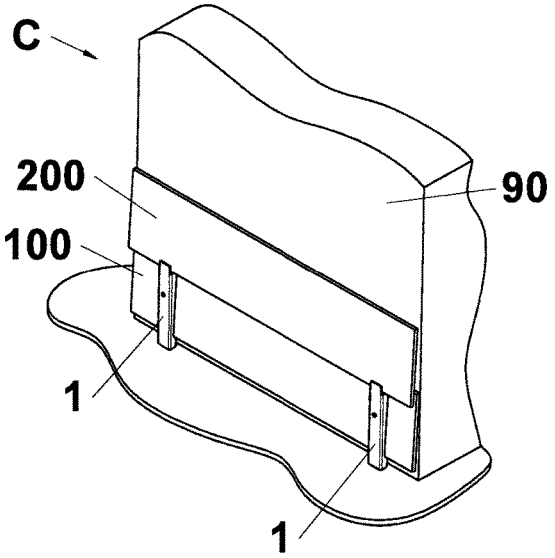
FIG. 8A is a perspective view of a third step positioning the bottom of a second lap siding panel on the upper ledges of the attached two gauges in FIG. 7.

FIG. 8A is a perspective view of a third step positioning the bottom of a second lap siding panel 90 on the upper ledges 22, 32 of the attached two gauges 1, 1B in FIG. 7.

FIG. 8B is an enlarged view of the first and second siding panel 100, 200 shown in FIG. 8A.

FIG. 8C is a right side view of FIG. 8B.

FIG. 8D is another view of FIG. 8C with panel and reveal dimensions.

As shown in FIG. 8D, the first installed panel has an approximately 6" reveal appearance effect, since the bottom edge of the second panel 200 covers part of the appearance of the original 7.25" height panel.

FIG. 8E is a top view of FIG. 8D.

Figure 9A:
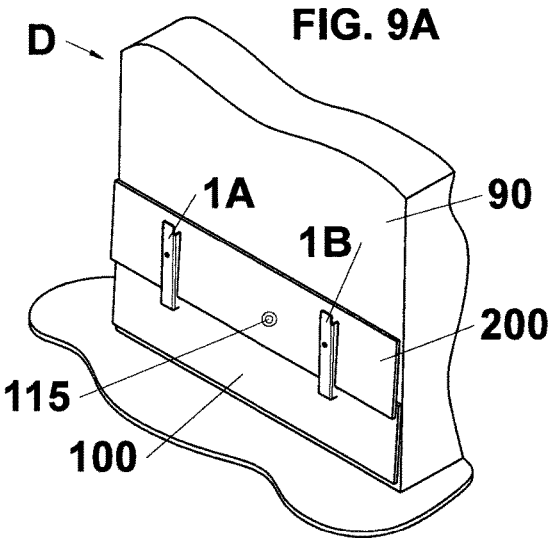
FIG. 9A is a perspective view of a fourth step after mounting the second lap siding panel to the wall, and now repositioning and attaching the two gauges to the mounted second lap siding panel.

FIG. 9A is a perspective view of a fourth step after mounting the second lap siding panel 200 to the wall 90 with additional fasteners 115 (such as but not limited to screws, nails and the like), and now repositioning and attaching the two gauges 1A, 1B to the mounted second lap siding panel 200.

Figure 9B:
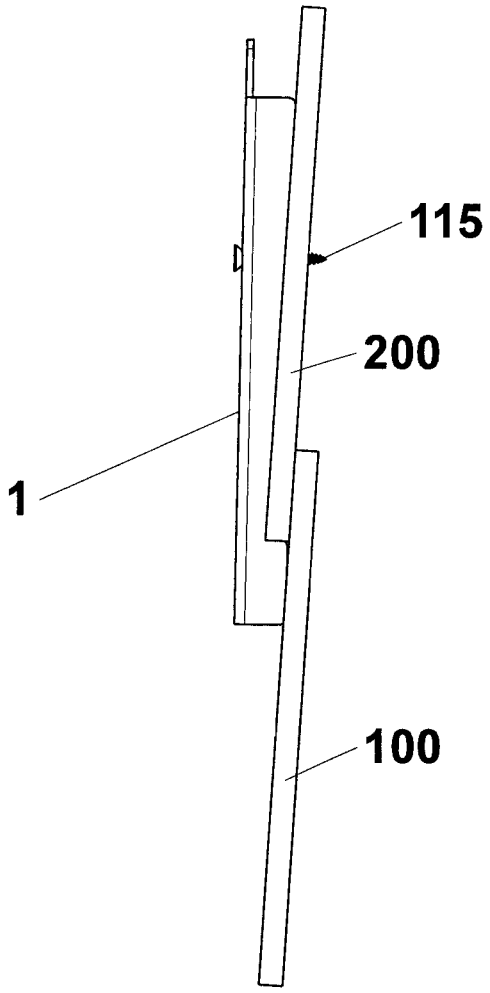
FIG. 9B is a right side view of FIG. 9A.

FIG. 9B is a right side view of FIG. 9A.

One installer can reuse the novel gauges 1, 1B on additional siding boards to build up the wall of lap siding until it is completed.

While the preferred embodiment describes a gauge tool having a height of approximately 7¼" high and a reveal of 6", the gauge tool can be made in other sizes. For example, the gauge tool can be manufactured for siding panels that are 8½" height, and have a reveal of approximately 7". Further the gauge tool can be manufactured for siding panels that are approximately 5¼" height with a reveal of approximately 4".

Although a preferred embodiment uses aluminum, the novel gauge can be formed from other metals, such as but not limited to galvanized metal, and the like.

The novel gauge can further be made from injection molded plastic, and the like from a mold.

The novel gauges can be sold in a kit form with two gauges, and assembly instructions so that a single installer can use the pair of gauges over and over for a single siding installation job.

Alternatively, the installer can attach a second pair of gauges on the second board, followed by inserting a third lap board in place. And use another pair of gauges to build up the wall, and so forth.

While the preferred embodiment is shown being used to install lap siding, the novel gauge tool can also be used for installing overlapping shingles on roofs, and the like.

The term "approximately"/"approximate" can be +/−15% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A system for installing lap siding on a vertical wall, consisting essentially of:

a first gauge having front rectangular panel with a left bent side with an upper left ledge and a lower left step, and a right bent side with an upper right ledge, and a lower right step, a first top middle panel extending upward from the front rectangular panel between the left bent side and the right bent side, and a first mounting hole through the front rectangular panel; and a second gauge having front rectangular panel with a left bent side with an upper left ledge and a lower left step, and a right bent side with an upper right ledge, and a lower right step, a second top middle panel extending upward from the second gauge front rectangular panel between the left bent side and the right bent side, and a second mounting hole through the second gauge front rectangular panel, wherein the first gauge and the second gauge are positioned parallel and spaced apart and are configured to be attached to an installed first siding panel on the vertical wall with at least one screw attached through the first mounting hole and the second mounting hole, and the lower left step and the lower right step of both the first gauge and the second gauge are positioned under a lower edge of the installed first siding panel, and a second siding panel is positioned on both the upper left ledge and the upper right ledge of the first gauge and on both the upper left ledge and the upper right ledge of the second gauge, followed by attaching the second siding panel to the vertical wall, wherein each of the first gauge and the second gauge have a height of approximately 7.25 inches from a bottom to each of the upper left ledge and the upper right ledge such that a reveal of the second siding panel is approximately 6 inches.

2. The system of claim 1, wherein the at least one screw is a first screw and a second screw.

3. The system of claim 1, wherein the first gauge and the second gauge are formed from a metal.

4. The system of claim 1, wherein the first gauge and the second gauge are formed from molded plastic.

5. The system of claim 1, wherein the first gauge and the second gauge are formed from aluminum plate material.

6. The system of claim 5, wherein the aluminum plate material includes a thickness of approximately 0.09 inches.

7. A system for installing lap siding on a vertical wall, consisting essentially of:

a first gauge having front rectangular panel with a left bent side with an upper left ledge and a lower left step, and a right bent side with an upper right ledge, and a lower right step, a first top middle panel extending upward from the front rectangular panel between the left bent side and the right bent side, and a first mounting hole through the front rectangular panel; and a second gauge having front rectangular panel with a left bent side with an upper left ledge and a lower left step, and a right bent side with an upper right ledge, and a lower right step, a second top middle panel extending upward from the second gauge front rectangular panel between the left bent side and the right bent side, and a second mounting hole through the second gauge front rectangular panel, wherein the first gauge and the second gauge are positioned parallel and spaced apart and are configured to be attached to an installed first siding panel on the vertical wall with at least one screw attached through the first mounting hole and the second mounting hole, and the lower left step and the lower right step of both the first gauge and the second gauge are positioned under a lower edge of the installed first siding panel, and a second siding panel is positioned on both the upper left ledge and the upper right ledge of the first gauge and on both the upper left ledge and the upper right ledge of the second gauge, followed by attaching the second siding panel to the vertical wall, wherein each of the first gauge and the second gauge have a height of approximately 8.5 inches from a bottom to each of the upper left ledge and the upper right ledge such that a reveal of the second siding panel is approximately 7 inches.

8. The system of claim 2, wherein the at least one screw is a first screw and a second screw.

9. The system of claim 2, wherein the first gauge and the second gauge are formed from a metal.

10. The system of claim 2, wherein the first gauge and the second gauge are formed from molded plastic.

11. The system of claim 2, wherein the first gauge and the second gauge are formed from aluminum plate material.

12. The system of claim 7, wherein the aluminum plate material includes a thickness of approximately 0.09 inches.

13. A system for installing lap siding on a vertical wall, consisting essentially of:

a first gauge having front rectangular panel with a left bent side with an upper left ledge and a lower left step, and a right bent side with an upper right ledge, and a lower right step, a first top middle panel extending upward from the front rectangular panel between the left bent side and the right bent side, and a first mounting hole through the front rectangular panel; and a second gauge having front rectangular panel with a left bent side with an upper left ledge and a lower left step, and a right bent side with an upper right ledge, and a lower right step, a second top middle panel extending upward from the second gauge front rectangular panel between the left bent side and the right bent side, and a second mounting hole through the second gauge front rectangular panel, wherein the first gauge and the second gauge are positioned parallel and spaced apart and are configured to be attached to an installed first siding panel on the vertical wall with at least one screw attached through the first mounting hole and the second mounting hole, and the lower left step and the lower right step of both the first gauge and the second gauge are positioned under a lower edge of the installed first siding panel, and a second siding panel is positioned on both the upper left ledge and the upper right ledge of the first gauge and on both the upper left ledge and the upper right ledge of the second gauge, followed by attaching the second siding panel to the vertical wall, wherein each of the first gauge and the second gauge have a height of approximately 5.25 inches from a bottom to each of the upper left ledge and the upper right ledge such that a reveal of the second siding panel is approximately 4 inches.

14. The system of claim 10, wherein the at least one screw is a first screw and a second screw.

15. The system of claim 10, wherein the first gauge and the second gauge are formed from a metal.

16. The system of claim 10, wherein the first gauge and the second gauge are formed from molded plastic.

17. The system of claim 10, wherein the first gauge and the second gauge are formed from aluminum plate material.

18. The system of claim 8, wherein the aluminum plate material includes a thickness of approximately 0.09 inches.

* * * * *